US005835017A

United States Patent [19]

Ohkura et al.

[11] Patent Number: 5,835,017

[45] Date of Patent: Nov. 10, 1998

[54] RADIO SEARCHING SYSTEM

[75] Inventors: Tadahiro Ohkura, Johyoh; Toshiyuki Yoshida, Yokohama; Mitsuru Kainuma, Chigasaki; Kazuo Aoki, Yokohama, all of Japan

[73] Assignee: Otax Co., Ltd., Japan

[21] Appl. No.: 688,198

[22] Filed: Jul. 29, 1996

Related U.S. Application Data

[63] Continuation of Ser. No. 399,552, Mar. 7, 1995, abandoned, which is a continuation-in-part of Ser. No. 301,643, Sep. 7, 1994, abandoned.

[30] Foreign Application Priority Data

| | | | |
|---|---|---|---|
| Oct. 1, 1993 | [JP] | Japan | 5-53488 |
| Oct. 21, 1993 | [JP] | Japan | 5-56983 |
| Dec. 27, 1993 | [JP] | Japan | 5-70092 |

[51] Int. Cl.[6] ..... G08B 21/00

[52] U.S. Cl. ..... 340/573; 340/569; 340/539

[58] Field of Search ..... 340/573, 572, 340/569, 539

[56] References Cited

U.S. PATENT DOCUMENTS

| | | | |
|---|---|---|---|
| 4,918,425 | 4/1990 | Greenburg | 340/573 |
| 5,014,040 | 5/1991 | Weaver | 340/573 |
| 5,218,344 | 6/1993 | Ricketts | 340/573 |
| 5,289,163 | 2/1994 | Perez | 340/573 |
| 5,396,224 | 3/1995 | Dukes | 340/573 |

*Primary Examiner*—Thomas Mullen
*Assistant Examiner*—Albert K. Wong
*Attorney, Agent, or Firm*—Lorusso & Loud

[57] ABSTRACT

In a radio searching system, a present position of an object under search such as a mentally handicapped aged person and a mountain climber is correctly defined and displayed by utilizing the characteristics of the radio signals. The radio searching system is comprised of a portable radio unit for transmitting a radio signal having a predetermined frequency, searching radio units provided at a plurality of searching points, for receiving the radio signal transmitted from the portable radio unit, a position defining unit for defining a position of an object under search on which the portable radio unit is mounted based on the transmission direction of the radio signal received by the searching radio unit, and an image display unit for displaying on an image, the position of the object under search defined by the position defining unit.

1 Claim, 4 Drawing Sheets

RADIO SEARCHING SYSTEM

CROSS REFERENCE TO RELATED APPLICATION

This application is a continuation of application Ser. No. 08/399,552 filed Mar. 7, 1995 and now abandoned which itself is a Continuation-in-Part of copending application Ser. No. 08/301,643 filed Sep. 7, 1994 entitled "SYSTEM FOR MONITORING A WEAK-MINDED PERSON" also abandoned.

BACKGROUND OF THE INVENTION

1. Field of the Invention

The present invention generally relates to a wireless type searching system. More specifically, the present invention is directed to a radio searching system capable of searching lost objects such as a mentally handicapped person and a pet by using a radio signal.

2. Description of the Related Art

Conventionally, neither methods, nor apparatuses have been developed, or commercially available which could avoid such risks that objects such as mentally handicapped persons, pets and mountain climbers may lose their way.

The term "mentally handicapped person" herein used refers to a person whose judgement is significantly lost because of derangement or the like and it means, for instance, an elderly person of senile dementia. Elderly persons of senile dementia lose their abilities or powers of memory, thinking, understanding, calculation, learning, speech, judgement, orientation, which is an ability for recognizing place and time, beyond the normal extent of symptom of old age and therefore they are likely to show abnormal behaviors called as problem behaviors, troublesome behaviors and the like such as acrania and fugue. In particular, fugue usually outbreaks unconsciously and therefore a person caring for an elderly person of fugue must always monitor behaviors of the elderly person. Such constant effort to monitor the elderly person should greatly load the person caring for the elderly person with physical and mental strains.

SUMMARY OF THE INVENTION

The present invention has been made in an attempt to solve the above-described problems, and therefore, has an object to provide a wireless type searching system capable of readily specifying a location of an object or a person who has last his way, e.g., a mentally handicapped person and a mountain climber, by utilizing characteristics of a radio signal.

To achieve the above-described object and other features of the present invention, a wireless type searching system according to the present invention is constructed of a portable radio unit for transmitting a radio signal having a predetermined frequency; searching radio units provided at a plurality of searching points, for receiving said radio signal transmitted from said portable radio unit; position defining means for defining a position of an object under search on which said portable radio unit is mounted based on the transmission direction of said radio signal received by said searching radio unit; and image display means for displaying on an image, said position of the object under search defined by said position defining means. The position defining means of such a wireless type searching system utilizes triangulation. The searching radio unit transmits another radio signal different from said radio signal having said predetermined frequency, and the portable radio unit transmits said radio signal having said predetermined frequency to said plurality of searching points when an input level of said radio signal transmitted from said searching radio unit becomes lower than a constant value.

The radio signal having the preselected frequency, which is transmitted from the portable radio unit, is received by the searching radio units provided at the respective searching points. Based upon the transmission direction of the radio signal having the predetermined frequency, which has received by the respective searching radio units, the position of the object under search is correctly defined by the position defining means with employment of, for instance, triangulation. Then, the present position of the searching object who has lost his way can be easily searched by displaying the position of the searching object defined by the position defining means on the image display means. Moreover, the above-described searching/portable radio units may have the below-mentioned functions, it is possible to readily judge as to whether or not there is such a risk that the object under search loses his way. That is, the searching radio unit transmits another radio signal different from the radio signal having the above-described predetermined frequency, whereas the portable radio unit transmits the radio signal having the predetermined frequency to the plurality of searching points when an input level of the radio signal transmitted from the searching radio unit becomes lower than a constant value.

BRIEF DESCRIPTION OF THE DRAWINGS

For a better understanding of the present invention, reference is made of the detailed description to be read in conjunction with the following drawings, in which.

DETAILED DESCRIPTION OF THE PREFERRED EMBODIMENTS

Figure 1:
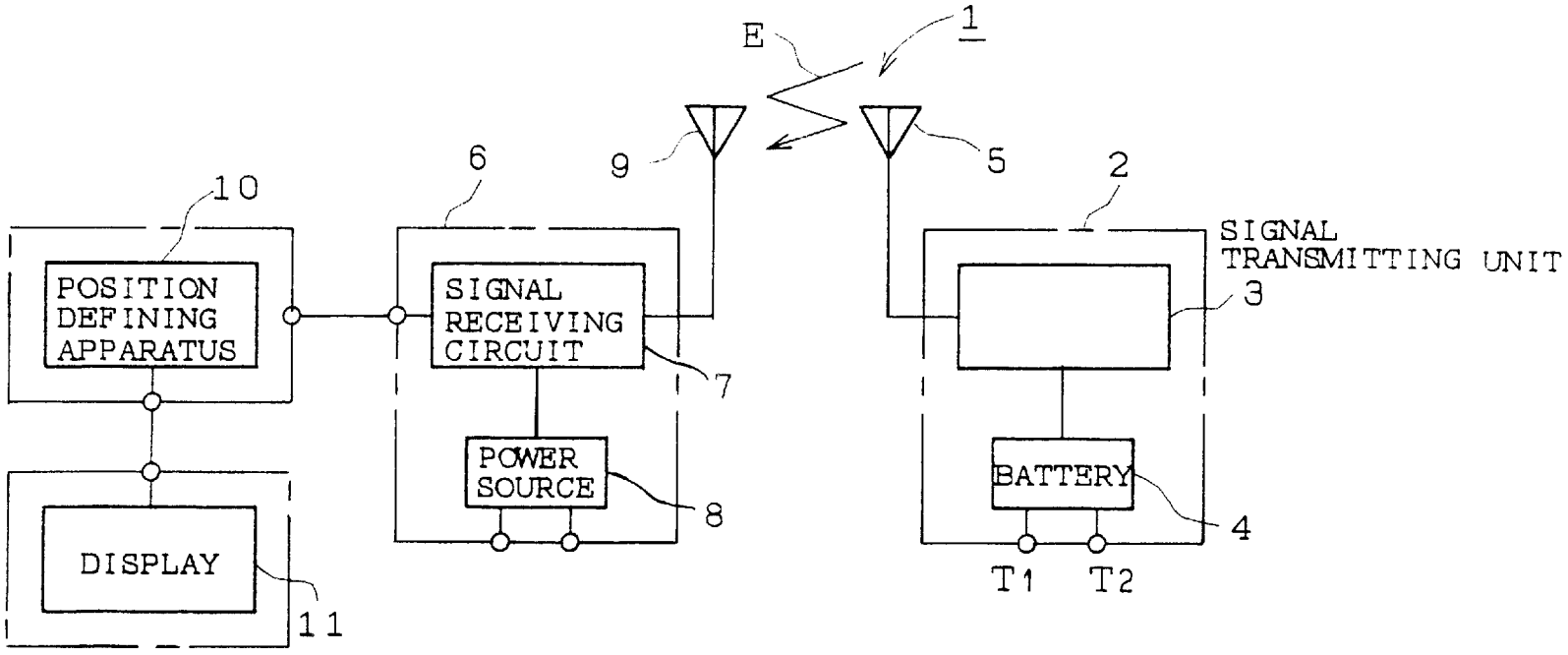
FIG. 1 is a schematic block diagram for illustrating an arrangement of a radio searching system according to a preferred embodiment of the present invention.

In FIG. 1, there is schematically shown an overall arrangement of a wireless (radio) type searching system 1 according to a preferred embodiment of the present invention. The radio searching system 1 is mainly constructed of a portable radio unit 2 for transmitting a radio signal having a preselected frequency, and a searching radio unit 6 for receiving the radio signal transmitted from the portable radio unit 2.

The portable radio unit 2 is provided at a preselected position of, for instance, a mentally handicapped aged person cared by a caring person. Such a radio unit 2 is equipped with a transmitter circuit 3 for transmitting a radio signal having a preselected frequency. The radio signal having such a preselected frequency may be obtained from analog signal waves, e.g., AM/FM signal waves produced from an oscillator whose oscillating amplitude and frequency are varied, or from pulse coded signals produced by a pulse code generator. Then, these signal waves, or signals are directly outputted, or are modulated by carrier signals and the modulated signals are outputted as vibration energy E such as high frequency signals, electromagnetic energy, and ultrasonic energy from a signal transmitting device (antenna) 5. The portable radio unit 2 includes this signal transmitting device 5 and further a battery or cell 4. The cell 4 is connected to recharging terminals $T_1$ and $T_2$ and may drive the transmitter unit 3. This cell 4 may be selected from an Ni—Cd battery and a secondary lithium battery. The cell 4 is connected via the recharging terminals $T_1$ and $T_2$ to a power source (not shown) so as to be recharged. This cell 4 constitutes a power source for driving the transmitter circuit 3 and other circuit elements.

The portable radio unit 2 may be preferably manufactured as a pendant type portable radio unit which can be hung from a neck of such a mentally handicapped aged person, a wristwatch type portable radio unit which can be mounted on his wrist, or a card type portable radio unit capable of easily fixed on his cloth. Namely, these preferable portable radio units may be continuously carried by the mentally handicapped aged person.

Figure 2:
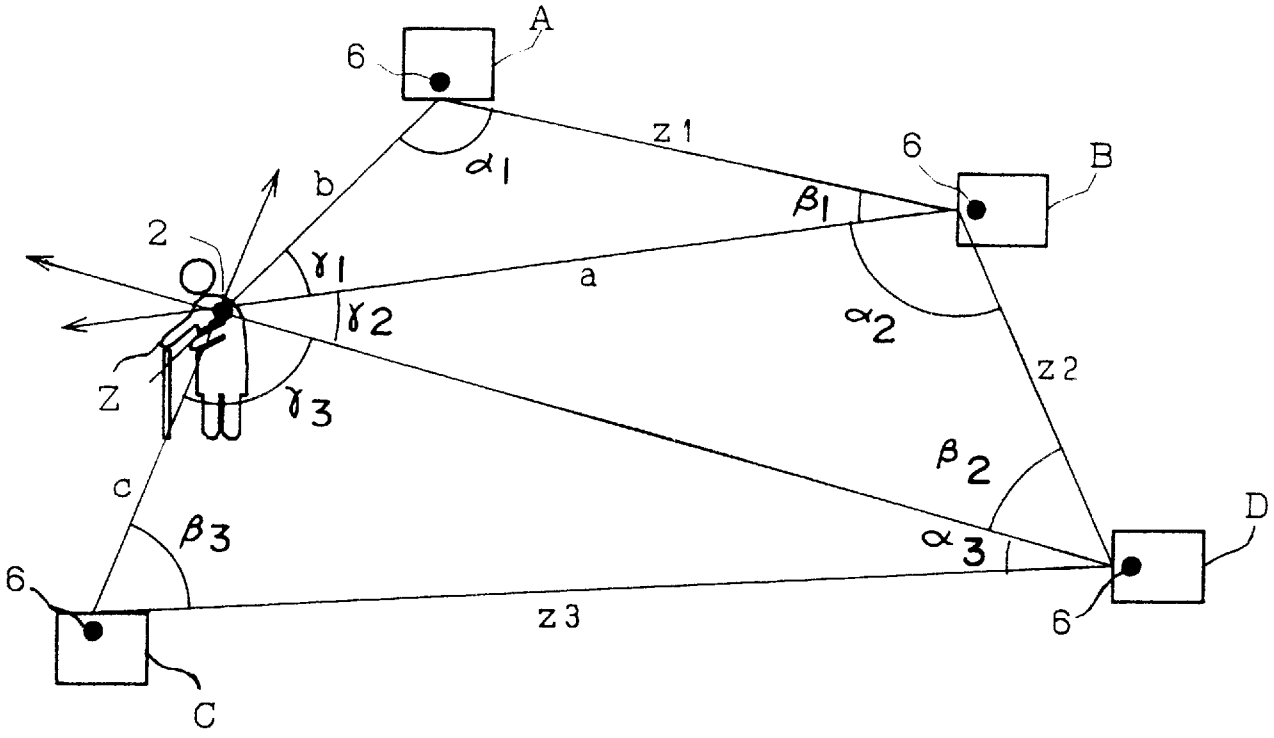
FIG. 2 is an illustration for explaining operations of the radio searching system shown in FIG. 1.

On the other hand, as illustrated in FIG. 2, the searching radio units 6 are positioned at searching base stations A, B, C and D while a region where the mentally handicapped aged people might wander is predefined. The searching radio unit 6 is equipped with a signal receiving device (antenna) 9 for receiving data transmitted as the vibration energy E such as high frequency energy, electromagnetic energy, and ultrasonic energy from the signal transmitting device (antenna) 5 of the portable radio unit 2 provided at a preselected position of the mentally handicapped aged people. The signal receiving device 9 is constructed by employing an antenna for receiving the vibration energy E to produce the AC power, and a coupler such as a coil, or a sound receiving member. It should be noted that the signal receiving device 9 may have sharp directivity in order to accurately define the place where the vibration energy E is emitted from the portable radio unit 2.

Referring back to FIG. 1, a signal receiving circuit 7 is connected to the signal receiving device 9. The signal receiving circuit 7 is connected to an AC power source unit 8 and further to a position defining apparatus 10 corresponding to a position defining means. This power source unit 8 converts the supplied AC power into the DC power so as to drive the signal receiving circuit 7.

The position defining apparatus 10 is capable of calculating the present position of the mentally handicapped aged person who has the portable radio unit 2 based upon the positional data produced from the searching radio units 6 installed at the searching base stations A, B, C and D. For instance, a present position of a mentally handicapped aged person may be precisely determined by triangulation based upon the respective directions of the vibration energy E received at the searching base stations A and B from the portable radio unit 2 carried by the mentally handicapped person.

Concretely speaking, if the distance $Z_1$ between the searching base stations A and B, and the angles $\alpha_1$, $\beta_1$ are measured, then the remaining two edge lengths, namely the distance "b" between the searching base station A and the mentally handicapped aged person Z, and also the distance "a" between the searching base station B and the mentally handicapped aged person Z may be calculated in accordance with the sine proportional rule of the trigonometrical survey as follows:

$$\gamma_1=180°-\alpha_1-\beta_1$$

$$a/\sin\alpha_1=b/\sin\beta_1=z_1/\sin\gamma_1$$

$$\therefore a=z_1/\sin\gamma_1\cdot\sin\alpha_1\quad b=z_1/\sin\gamma_1\cdot\sin\beta_1 \tag{1}$$

Similar to the above-described formula (1), when both of the distance $Z_2$ between the searching base stations B and D, and the angles $\alpha_2$, $\beta_2$; and the distance $Z_3$ between the searching base stations D and C, and the angles $\alpha_3$, $\beta_3$ are measured, the distance "d" between the searching base station D and the mentally handicapped aged person Z, and also the distance "c" between the searching base station C and the mentally handicapped aged person Z may be calculated. As a result, the present position of the mentally handicapped aged person under search can be correctly defined, or specified. The position defining apparatus 10 further owns such a function to display the calculated present position on the map. This function implies that the map data such as a map database used in a car (automobile) navigation system (GPS) is stored, and the respective searching base stations A, B, C, D are clearly displayed in conjunction with the map data. The position defining apparatus having such a function is connected to a display 11 corresponding to an image display means.

Figure 3B:
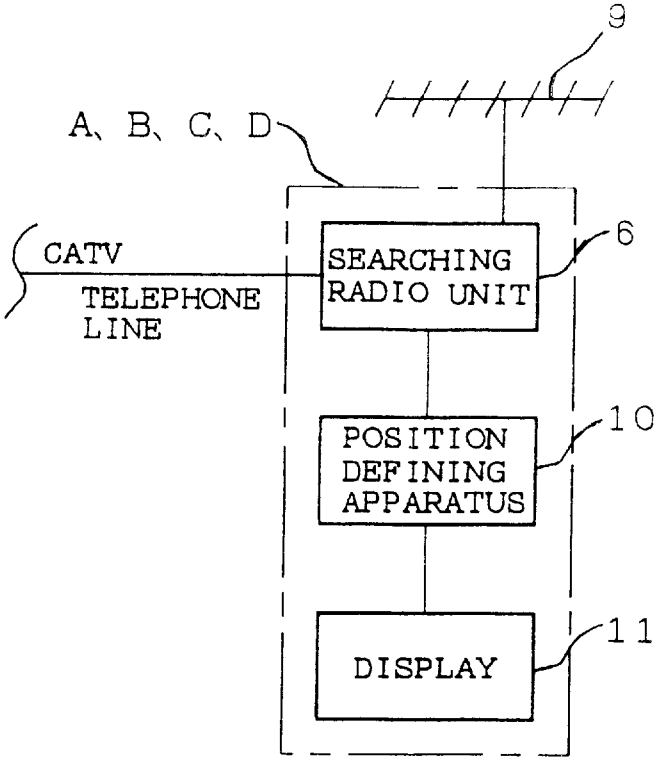
FIG. 3 is an explanatory diagram for explaining operations of the radio searching system of FIG. 1.
Figure 3A:
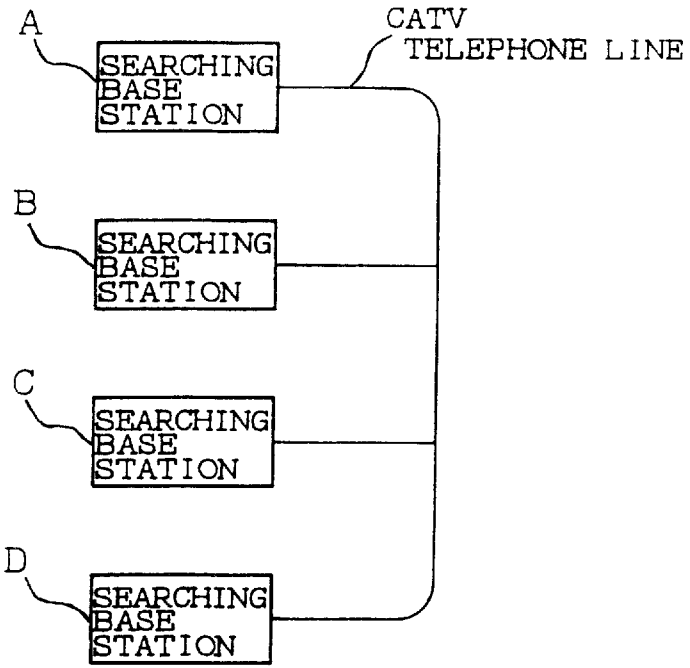

The method for finding the mentally handicapped aged person who has lost his way by employing the radio searching apparatus with the above-described arrangement will now be explained with reference to FIG. 1 to FIG. 3.

When the mentally handicapped aged person has lost his way on which the portable radio unit 2 for outputting such vibration energy E in the form of high frequency signals having a preselected frequency, electromagnetic signals, and ultrasonic signals is mounted at a preselected position, the search operation is commenced by using the searching radio units 6 installed at the respective searching base stations A, B, C and D. The signal receiving device 9 of each of the searching radio units 6 positioned at the respective searching base stations A, B, C, D receives the vibration energy E outputted from the signal transmitting device 5 of the portable radio unit 2, and converts this vibration energy E into the AC power which will be then supplied to the signal receiving circuit 7. The signal receiving circuit 7 produces the positional data based on this AC power, and outputs this positional data to the position defining apparatus 10 by utilizing a CATV (community antenna television) line and a telephone line. The position defining apparatus 10 calculates the positional data about the present position of the mentally handicapped aged person which is captured by the searching radio units of the respective searching base stations A, B, C, D, and thereafter supplies the resulting positional data to the display 11. Since the present position calculated by the position defining apparatus 10 can be represented on the map by the display 11, the present position of the mentally handicapped aged person can be correctly grasped therefrom.

Figure 4:
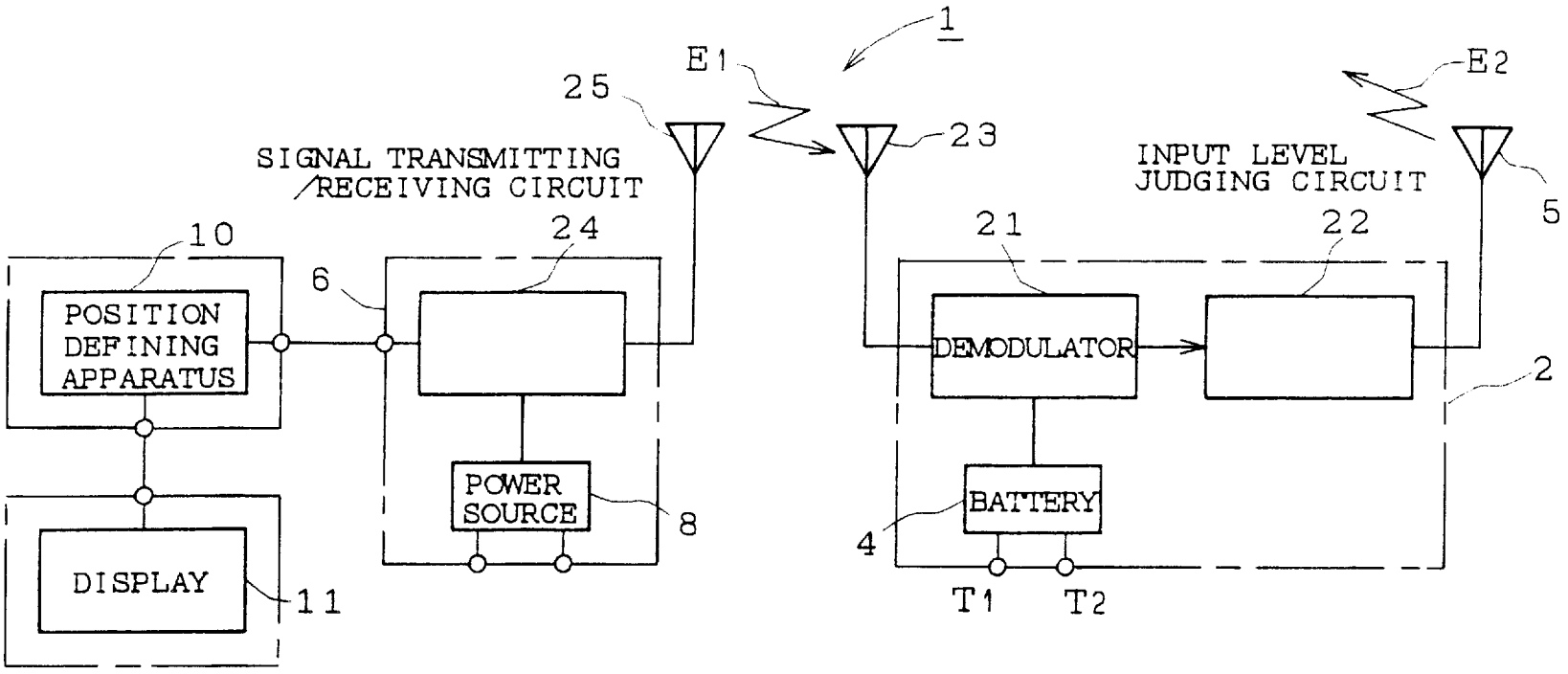
FIG. 4 is a schematic block diagram for representing an arrangement of a radio searching system according to another preferred embodiment of the present invention.

It should be noted that in the above-described embodiment, the portable radio unit 2 of this radio searching apparatus 1 has the function only to transmit the vibration energy E, and the searching radio unit 6 owns the function only to receive this vibration energy E. However, the present invention is not limited to the above-described embodiment, but may be modified. That is, as represented in FIG. 4, the portable radio unit 2 may include a signal receiving device 23, a demodulator 21, and an input level judging circuit 22, whereas the searching radio unit 6 may include a signal transmitting/receiving device 25 and a signal transmitting/receiving circuit 24. When the mentally handicapped aged person on which this portable radio unit 2 is installed at a preselected place is separated from the searching radio unit 6 by a predetermined distance, the input level of the vibration energy $E_1$ such as the high frequency, electromagnetic and ultrasonic energy outputted from the signal transmitting/receiving devices 25 of the searching radio unit 6 becomes lower than a preselected value. Then, the input level judging circuit 22 of the portable radio unit 2 can output another vibration energy $E_2$ from the signal transmitting device 5 based on such vibration energy $E_1$. As a consequence, it is possible to readily judge whether or not there are some risks that the mentally handicapped aged person on which this portable radio unit 2 is mounted may lose his way.

Alternatively, the communication between the portable radio unit and the searching radio unit may be established via a satellite.

The above-described radio searching apparatus may be utilized to search not only mentally handicapped aged people, but also mountain climbers and pet animals in case of emergency.

As apparent from the above-described embodiments, the wireless type searching system according to the present invention is comprised of a portable radio unit for transmitting a radio signal having a predetermined frequency; searching radio units provided at a plurality of searching points, for receiving the radio signal transmitted from the portable radio unit; position defining means for defining a position of an object under search on which the portable radio unit is mounted based on the transmission direction of the radio signal received by the searching radio unit; and image display means for displaying on an image, the position of the object under search defined by the position defining means. Furthermore, the position defining means utilizes triangulation. Accordingly, the present position of the object under search who has lost his way can be easily searched. Also, when the above-described searching/portable radio units may have the below-mentioned functions, it is possible to readily judge as to whether or not there is such a risk that the object under search loses his way. That is, the searching radio unit transmits another radio signal different from the radio signal having this above-described predetermined frequency, whereas the portable radio unit transmits the radio signal having the predetermined frequency to the plurality of searching points when an input level of the radio signal transmitted from the searching radio unit becomes lower than a constant value.

What is claimed is:

1. A wireless type searching system comprising:

a portable radio unit mounted on an object for transmitting a radio signal having a predetermined frequency;

a plurality of searching radio units installed at a corresponding plurality of searching base stations for receiving said radio signal transmitted from said portable radio unit;

position defining means for determining a position of the object based on at least two transmission directions of said radio signal received by said searching radio units installed at at least two of said base stations and on a distance between the searching base stations;

image display means for displaying as an image said position of the object defined by said position defining means;

said searching radio units transmitting another radio signal different from said radio signal having said predetermined frequency; and said portable radio unit transmitting said radio signal having said predetermined frequency to said plurality of searching points when an input level of said different radio signal transmitted from said searching radio units becomes lower than a predetermined value.

* * * * *